US008241399B2

(12) United States Patent
Albers

(10) Patent No.: US 8,241,399 B2
(45) Date of Patent: Aug. 14, 2012

(54) THERMO-CHEMICAL HEAT PUMP AND METHODS OF GENERATING HEAT FROM A GAS STREAM

(76) Inventor: Walter Albers, Paradise Valley, AZ (US)

( * ) Notice: Subject to any disclaimer, the term of this patent is extended or adjusted under 35 U.S.C. 154(b) by 422 days.

(21) Appl. No.: 12/467,269

(22) Filed: May 16, 2009

(65) Prior Publication Data

US 2009/0283242 A1 Nov. 19, 2009

Related U.S. Application Data

(60) Provisional application No. 61/127,955, filed on May 16, 2008.

(51) Int. Cl.
*B01D 53/06* (2006.01)
*B01D 53/14* (2006.01)

(52) U.S. Cl. ..... 95/92; 95/113; 95/114; 95/117; 95/194; 95/209; 95/227; 95/231

(58) Field of Classification Search ..... 165/60, 165/111; 62/121, 94, 271; 95/92, 113, 117, 95/194, 209, 227, 231, 114
See application file for complete search history.

(56) References Cited

U.S. PATENT DOCUMENTS

| | | | | |
|---|---|---|---|---|
| 4,967,829 | A * | 11/1990 | Albers et al. | 165/109.1 |
| 4,984,434 | A * | 1/1991 | Peterson et al. | 62/94 |
| 5,020,335 | A * | 6/1991 | Albers et al. | 62/271 |
| 5,097,668 | A * | 3/1992 | Albers et al. | 62/94 |
| 5,123,481 | A * | 6/1992 | Albers et al. | 165/111 |
| 2005/0109052 | A1 * | 5/2005 | Albers et al. | 62/271 |

* cited by examiner

*Primary Examiner* — Duane Smith
*Assistant Examiner* — Ives Wu
(74) *Attorney, Agent, or Firm* — Parsons & Goltry; Michael W. Goltry; Robert A. Parsons

(57) ABSTRACT

A method of generating heat from a gas stream includes providing a first gas stream having a first temperature and a moisture content approximately saturating the gas stream, removing the moisture content from the first gas stream to form a second gas stream having a second temperature greater than the first temperature of the first gas stream, and heat exchanging the second gas stream having the second temperature greater than the first temperature of the first gas stream.

10 Claims, 10 Drawing Sheets

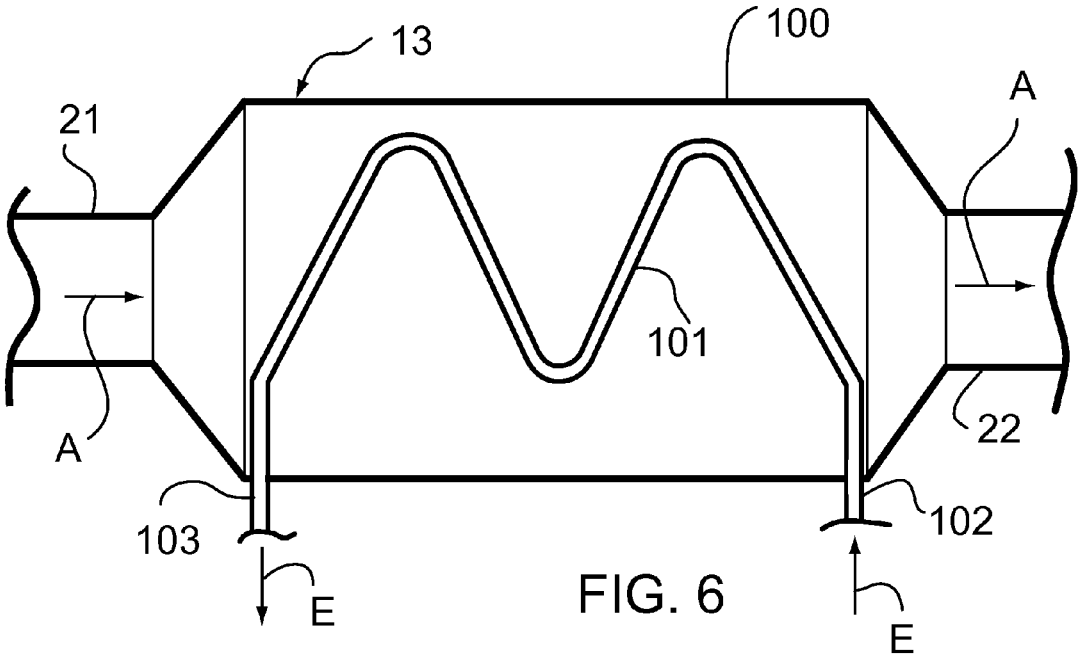
FIG. 6
FIG. 7
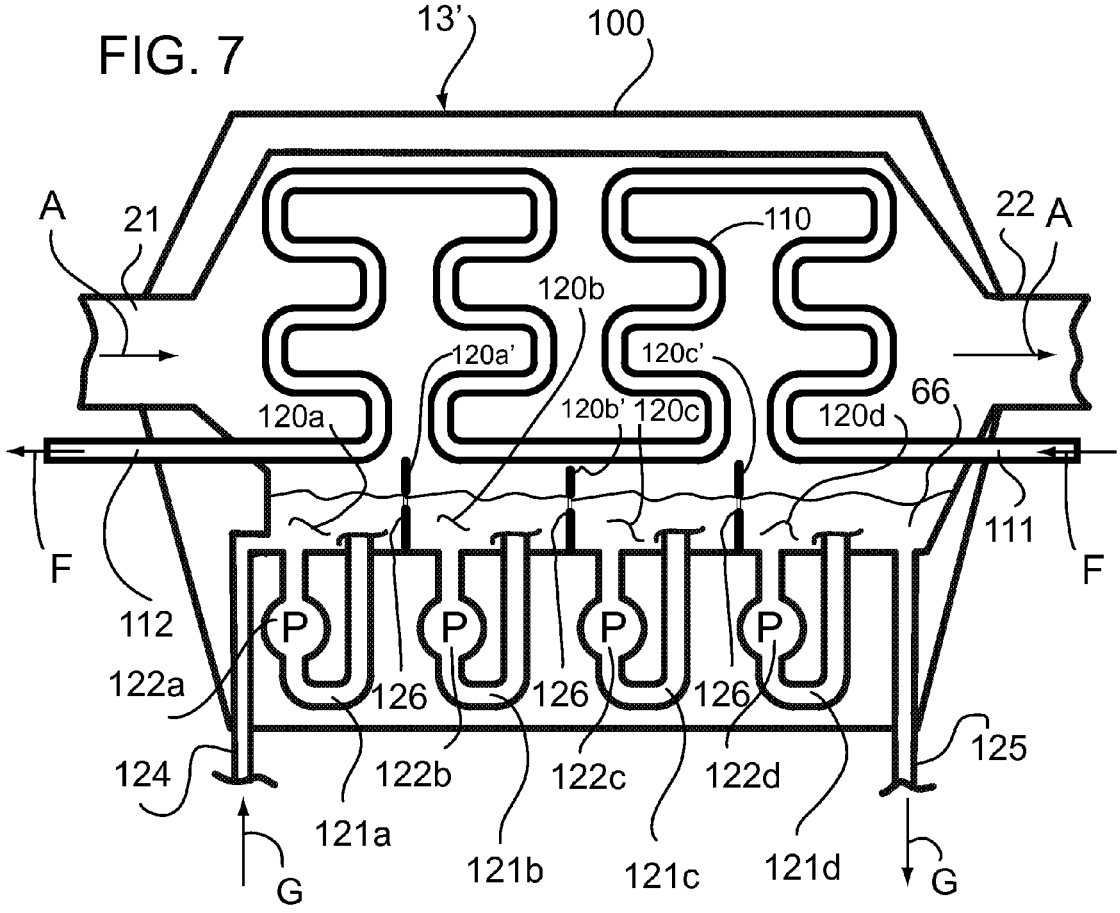

THERMO-CHEMICAL HEAT PUMP AND METHODS OF GENERATING HEAT FROM A GAS STREAM

CROSS-REFERENCE TO RELATED APPLICATION

This application claims the benefit of U.S. Provisional Patent Application Ser. No. 61/127,955, filed May 16, 2008.

FIELD OF THE INVENTION

The present invention relates to processes for elevating gas temperatures and, more particularly, for increasing temperatures of thermal sources, including low grade thermal sources or resources, for use in improving heat pump operation, electrical power generation, and other beneficial processes.

BACKGROUND OF THE INVENTION

Numerous low temperature resources have not been utilized for heat pumping or for electric power production because of low conversion efficiency and capital cost considerations. Techniques to partially solve these difficulties have been developed and generally involve complex and multiple expensive pressure vessels or chambers. Accordingly, there is a need in the art for systems and methods to economically, easily, and efficiently utilizing the energy provided by low grade thermal sources, including natural low grade thermal sources.

SUMMARY OF THE INVENTION

By raising the temperature of low grade thermal resources, including ground water sources, the operational efficiencies of geothermal heat pumps and the electrical generation efficiencies turbine and Rankin cycle machines are improved due to expansion of the spread between the highest and lowest process temperatures. Also beneficial is using low grade energy from presently unused resources that have already been brought to the surface such as water separated at oil and gas wells. A renewable base-load consideration is solar ponds which heretofore have produced temperatures insufficient for economical generation of electricity.

According to the principle of the invention, a method of elevating a temperature of a gas includes providing a first gas stream having a first temperature and a moisture content approximately saturating the gas stream, removing the moisture content from the first gas stream to form a second gas stream having a second temperature greater than the first temperature of the first gas stream, and heat exchanging the second gas stream having the second temperature greater than the first temperature of the first gas stream. The step of providing the first gas stream having the first temperature and the moisture content approximately saturating the first gas stream includes providing a heater, applying the gas stream to the heater in stages and in a counter-current manner, and the heater interacting with the gas stream producing the first gas stream having an elevated first temperature, the heater receiving its heat from a thermal source which is generally heated water, a saturator contacting the gas stream in each stage allowing moisture to evaporate into the constantly elevating temperature of the first gas stream to produce the first gas stream having the first temperature and the moisture content approximately suturing the first gas stream.

The step of removing the moisture content from the first gas stream to form the second gas stream having the second temperature greater than the first temperature of the first gas stream includes providing a dehumidifier, applying the first gas stream to the dehumidifier, and the dehumidifier interacting with the first gas stream to remove the moisture content from the first gas stream to form the second gas stream having the second temperature greater than the first temperature of the first gas stream. The step of the dehumidifier interacting with the first gas stream to remove the moisture content from the first gas stream to form the second gas stream having the second temperature greater than the first temperature of the first gas stream includes the dehumidifier contacting the first gas stream in a staged manner with a desiccant removing the moisture content from the first gas stream to form the second gas stream having the second temperature greater than the first temperature of the first gas stream. The step of contacting the first gas stream with the desiccant further includes contacting the first gas stream with a liquid desiccant, and contacting the first gas stream with the liquid desiccant includes providing a source of the liquid desiccant, and coupling the source of the liquid desiccant to the dehumidifier to apply the liquid desiccant to the dehumidifier in a flow that is counter-current to the in its contact with the first air stream.

In another embodiment, the step of contacting the first gas stream with the desiccant includes contacting the first gas stream with a solid desiccant. In this embodiment, the step of contacting the first gas stream with the solid desiccant further includes applying the solid desiccant to more than one wheel coupled to the dehumidifier in a staged manner, and rotating more than one wheel with respect to the dehumidifier to rotate the solid desiccant to contact the first gas stream.

The step of heat exchanging the second gas stream having the second temperature greater than the first temperature of the first gas stream includes providing a heat exchanger, and applying the second gas stream having the second temperature greater than the first temperature of the first gas stream to the heat exchanger heat exchanging the second gas stream at the heat exchanger in a counter-current and staged manner. In this embodiment, a further step of the method includes dehumidifying the second gas stream currently with heat exchanging the second gas stream at the heat exchanger. The step of dehumidifying the second dry stream currently with heat exchanging the dry gas stream at the heat exchanger includes contacting the second gas stream with a desiccant at the heat exchanger currently with heat exchanging the second gas stream at the heat exchanger. The step of contacting the second gas stream with the desiccant further includes contacting the second gas stream with a liquid desiccant, in which the step of contacting the second gas stream with the liquid desiccant in a preferred embodiment includes providing a source of the liquid desiccant, and coupling the source of the liquid desiccant to the heat exchanger to apply the liquid desiccant to the heat exchanger to contact the second air stream.

BRIEF DESCRIPTION OF THE DRAWINGS

Referring to the drawings:

FIG. 6 is a schematic diagram of a heat exchanger of the thermo-chemical heat pump of FIG. 1;

FIG. 7 is a schematic diagram of an alternate embodiment of a heat exchanger for use with the thermo-chemical heat pump of FIG. 1;

DETAILED DESCRIPTION OF PREFERRED EMBODIMENTS

Figure 1:
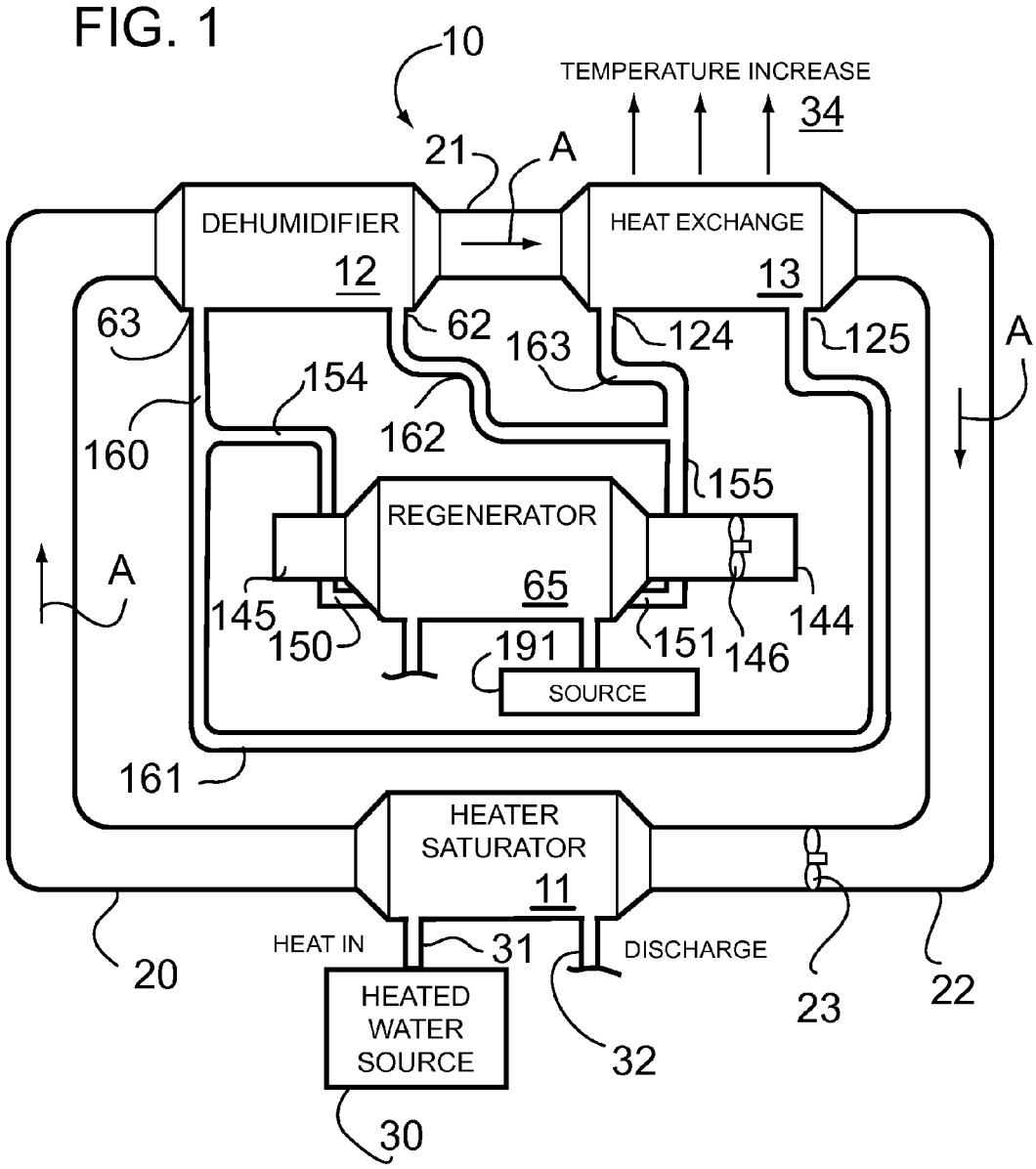
FIG. 1 is a schematic diagram of a thermo-chemical heat pump constructed and arranged in accordance with the principle of the invention.

Evaporative cooling or the adding moisture to an air stream to cool the air stream is a well known and commonly used process. This exchange of heat in the evaporative cooling process is adiabatic because there is no energy change to the air. In thermodynamics, this process of exchanging moisture for heat is reversible, whereby adding moisture to air reduces the temperature of the air, and removing moisture from air increases the temperature of the air. In the former process, the air is subjected to water; in the second process, the air is in contact with a desiccant. The technology employed herein makes use of both processes but also changes the energy content of air by adding and taking away heat.

According to the principle of the invention, a first portion of a process carried out in accordance with the principle of the invention involves increasing the temperature of a gas, generally air, while maintaining the gas as saturated or otherwise in a saturated condition, in which the terms "saturated" and "saturated condition" each mean the gas is holding as much vapor as possible. Energy in air, for instance, is a combination of its temperature content and its moisture content. For example, saturated air at 160° F. contains almost nine times the energy contained in saturated air at 80° F. even as its temperature has only doubled. To heat air, for example, the air can be directly exposed counter-currently to a flow of ground water or to hot water from a low temperature geothermal source or to heated water surfaced during oil or gas extraction.

The next step in the process is dehumidifying the saturated gas, preferably by contacting the saturated gas with a desiccant. A desiccant is a hydroscopic substance that encourages a state of dryness. Rice and salt are known desiccants and can be used, while modern forms of desiccants include solids such as silica gel, or liquids including concentrated sea water or lithium bromide. With respect especially to liquid desiccants, this includes the moisture content of saturated air at various temperatures, air temperatures achievable when exposed to various desiccant concentrations, and effects of diluting the desiccant. The desiccant, which has a low vapor pressure, absorbs moisture until its vapor pressure is in equilibrium with the vapor pressure of the surrounding air.

In a particular example, consideration is made to an instance where gas stream and desiccant equilibriums occur at 10% relative humidity, in which 160° F. saturated air with 100% relative humidity would not reach equilibrium until it was at a 10% relative humidity. Because the reduction in moisture is an adiabatic process, the air maintains a constant energy by taking on heat as it concurrently loses moisture. Balances are achieved when the air stream reaches a temperature of almost 275° F. In this manner, an 80° F. air stream would be increased in temperature by almost 200° F. while extracting heat from a liquid stream over 100° F. cooler.

Following dehumidification the higher temperature gas achieved, which is a beneficial product produced by the process, can be beneficially utilized, whether directly or through heat exchanging with another source. When cooling, the air can saturate at a relatively high temperature, as in the above example the 275° F. air at 157° F. In a particular example, following dehumidification the higher temperature gas is heat exchanged with another source and is concurrently continually dehumidified as its relative humidity increases as it cools. With continual dehumidification, the air temperature of the above example may be heat exchanged to near 100° F. before saturation.

Moisture is removed from the desiccant by once again adjusting the relative humidity but of another air stream. As an example, air conditioners are often tested against the harsh climatic conditions of 95° F. and 40% relative humidity. Raising the temperature of this ambient air stream to 150° F. will reduce its relative humidity sufficiently to restore the desiccant to its first concentration.

Referring now to the drawings, in which like reference characters indicate corresponding elements throughout the several views, attention is first directed to FIG. 1, in which there is seen a schematic diagram of a thermo-chemical heat pump 10 constructed and arranged in accordance with the principle of the invention. Thermo-chemical pump 10 makes use of a stream of gas or gas stream denoted by the arrowed lines A in FIG. 1. The gas of gas stream preferably consists of air or ambient air, and may, in other examples, include carbon dioxide, nitrogen, helium, or other gas or combination of gases.

According to the principle of the invention, gas stream A repeatedly circulates through thermo-chemical pump 10 and can be configured to operate under a nearly constant pressure, with modest pressure changes caused by frictional losses. The gas of the gas stream A is generally at nearly atmospheric pressure, but in other examples other pressures or vacuums may be employed in pump 10. The gas of the gas stream A is a sensible and latent heat transfer media, according to the principle of the invention.

As is generally understood, heat transfer is the movement of energy that cools or heats a fluid, whether a liquid or a gas, or evaporates a liquid or condenses a vapor that exchanges heat through a gas/liquid interface. Mass transfer is the movement of an evaporating liquid from the liquid phase into the gas phase or movement of a condensing vapor from a gas phase into a liquid phase.

Looking now to FIG. 1, thermo-chemical pump 10 consists of a heater-saturator 11, a dehumidifier 12, and a heat exchanger 13, which are coupled in gaseous communication with gas stream A. Gas stream A is heated and saturated by heater-saturator 11, dehumidified by dehumidifier 12 thereby increasing the heat of gas stream A, which heated gas stream A is then applied to heat exchanger 13 for heat exchanging. From heat exchanger 13, gas stream A is then applied back to heater-saturator 11 and the process so continues. In other words, heater-saturator interacts with or otherwise acts on gas stream A to heat and saturate gas stream A, dehumidifier 12 interacts with or otherwise acts on gas stream A to dehumidify gas stream A, and heat exchanger 13 interacts with or otherwise acts on gas stream A to heat exchange with gas stream A. Gas stream A heated and saturated by heater-saturator 11 on its way to dehumidifier may be considered one gas stream of gas stream A, gas stream A dehumidified by dehumidifier 12 on its way to heat exchanger 13 may be considered another gas stream of gas stream A, and gas A leaving heat exchanger 13 on its way back to heater-saturator 11 may be considered yet another gas stream of gas stream A.

In a preferred embodiment, a plenum 20 couples heater-saturator in gaseous communication to dehumidifier 11, a plenum 21 couples dehumidifier 11 to heat exchanger 13 in gaseous communication, and a plenum 22 couples heat exchanger 13 to heater-saturator 11 in gaseous communication. A conventional fan or blower 23 is operatively coupled to interact with gas stream A to circulate gas stream A through thermo-chemical pump 10, namely, through plenums 20-22, heater-saturator 11, dehumidifier 12, and heat exchanger 13. In the present embodiment, blower 23 is positioned in plenum 22 between heat exchanger 13 and heater-saturator 11, and it may be located in gas stream A at other locations if so desired. In response to activation of fan or blower 23, a gas stream denoted by arrowed line A is formed, which passes through heater-saturator 11 to plenum 20, from plenum 20 to dehumidifier 12, from dehumidifier 12 to plenum 21, from plenum 21 to heat exchanger 13, from heat exchanger 13 to plenum 22, and from plenum 22 back to saturator 11. As such, gas stream A circulates between heater-saturator 11, dehumidifier 12, and heat exchanger 13, in accordance with the principle of the invention. Although thermo-chemical pump 10 utilizes one fan or blower 23 in the present embodiment, more can be used.

In the operation of thermo-chemical pump 10, gas stream A passes first through heater-saturator 11, then through dehumidifier 12, then through heat exchanger 13, and then back to heater-saturator 11 for repeated cycles through thermo-chemical pump 10. As gas stream A passes through heater-saturator 11, heater-saturator 11 interacts with or otherwise acts on gas stream A such that gas stream A is heated and saturated by heater-saturator 11 by being contacted with water in heater-saturator 11. When gas stream A is heated and saturated, it consists of a mixture of the gas of gas stream A and water vapor at or near its maximum concentration for a prevailing temperature and pressure. The gas of gas stream A in this context is referred to as saturated or a saturated gas when the vapor pressure of water in the gas of gas stream A is at the equilibrium vapor pressure for water vapor at the temperature of the mixture of the gas of gas stream A and the water vapor, such that gas stream A has a moisture content saturating or approximately saturating gas stream A.

Heater-saturator 11 is formed with an inlet 31 formed proximate to plenum 20, and an outlet 32 formed proximate to plenum 22. Inlet 31 is coupled to a thermal source. More particularly, inlet 31 is coupled in fluid communication to receive heated water from a heated water source 30, which, in this preferred embodiment, is a preferred thermal source consisting of heated water having a temperature greater than the temperature of gas stream A entering saturator 11 from plenum 22. Heated water source can be natural, such as from a thermal spring, or artificially produced, such as with a water heater, or may be another type of thermal source. Inlet 31 is coupled to receive heated water from heated water source 30, which passes through heater-saturator 11 in stages and counter currently with respect to gas stream A, and is discharged from heater-saturator 11 through outlet 32. Direct heat exchange between gas stream A through heater-saturator 11 with the heat of the heated water of heated water source 30 applied to heater-saturator 11 via inlet 31 occurs in heater-saturator 11, and is discharged from heater-saturator 11 through outlet 32 coupled to heater-saturator 11. This heat exchange is direct heat exchange in a preferred embodiment. In an alternate embodiment, the heat exchange in heater-saturator 11 is indirect heat exchange, and this aspect is discussed later in this specification.

In the direct heat exchange mode of operation of heater-saturator 11, which is preferred because it is simple and inexpensive given that the fluid need not be maintained under pressure and heating and saturation occur simultaneously, contact of gas stream A in heater-saturator 11 with the heated water of heated water source 30 passing therethrough raises the temperature of gas stream A and evaporates water vapor from the heated water of heated water source 30 into gas stream A as the saturation condition of the gas of gas stream A continually changes to saturate gas stream A with the heated water of from heated water source 30, which saturated gas stream A is applied to plenum 20 from saturator 30 to begin its journey through thermo-chemical pump 10 to dehumidifier 12. Saturated gas stream A applied to plenum 20 from heater-saturator has a temperature and a moisture content that incorporates saturating or approximately saturating gas stream A.

In an indirect mode of heat exchange in heater-saturator 11, there is separate heat exchange between the heated water of heated water source 30 and gas stream A while saturation at increasing temperatures is caused by a dedicated wetting of gas stream A with a wetter or wetting system. The closest temperature approaches between the gas stream A and heated water source 30 are created if gas stream A and the heat from heated water source 30 pass in a staged manner and counter-currently with respect to one another. These modes of operation are described in connection with FIG. 2 and FIG. 3 below.

Figure 10:
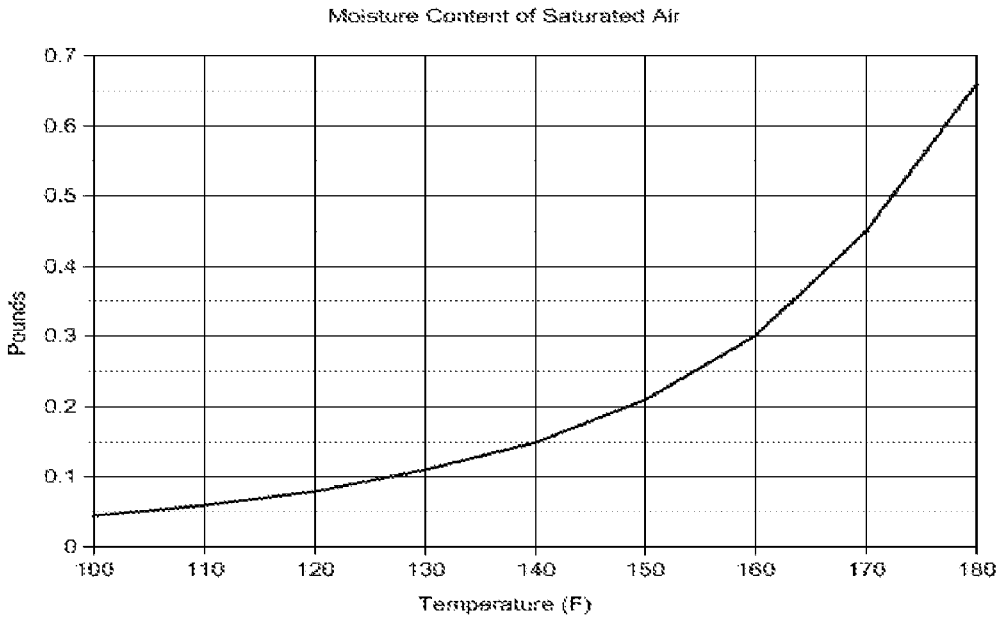
FIG. 10 is a graph of the moisture content of saturated air in a temperature range of from 100° F. to 180° F.

In order to achieve temperatures suitable for electric power generation, for instance, gas saturation temperatures required are far in excess of those typically encountered. At the harsh climatic test of 95° F. and 40% relative humidity mentioned earlier, moisture content is 0.014 pounds of water per pound of gas. In a typical air conditioning operation this level is reduced such that interior space can be maintained at approximately 0.011 pounds. For reference, a "pound" of air represents approximately 15 cubic feet or a cube about 2.5 feet per side. FIG. 10 displays moisture content of elevated saturated air temperature range from 100° F. to 180° F. At 100° F., for example, air has a saturated moisture content of approximately 0.04 pounds water per pound of air, while at 180° F., moisture content is 0.66 pounds.

Figure 11:
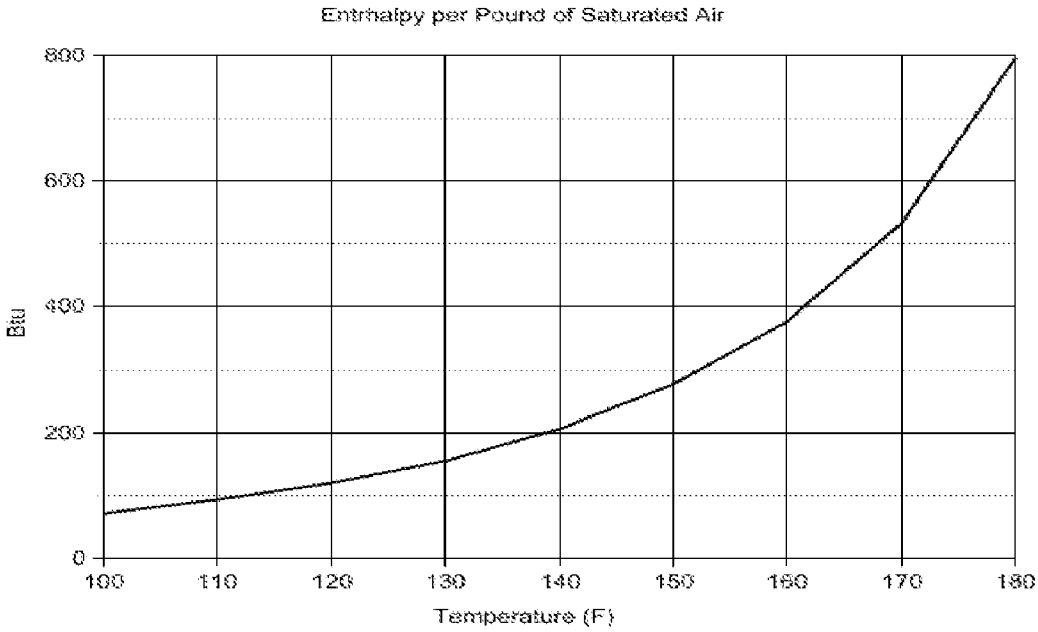
FIG. 11 is a graph of the enthalpy content of saturated air in a temperature range of from 100° F. to 180° F.

The energy content of saturated air greatly increases concurrently with its rise in temperature. This energy, spoken of as specific enthalpy, is the sum of heat of the air and as well as the water vapor contained therein. Enthalpy is given in joules per kilogram of air or in Btu per pound of air. The enthalpy content of saturated air at higher temperatures is generally overlooked in the literature. As seen in FIG. 11, at 180° F. the enthalpy of a pound of air is nearly 800 Btu, a level that represents 70% the enthalpy contained in a pound of steam.

Upon reaching the desired temperature and enthalpy level as found in the upper ranges of the above charts, the gas of gas stream A passing through heater-saturator 11 is saturated by heater-saturator 11, and is applied to plenum 20 from heater-saturator 11, passes through plenum 20, and is then applied to dehumidifier 12 from plenum 20. Gas stream A has a temperature and moisture content when it enters dehumidifier 12 from plenum 20. Dehumidifier 12 interacts with or otherwise acts on gas stream A such that gas stream A is dehumidified by dehumidifier 12 and, as a result thereof, heated to a temperature greater than the temperature of gas stream A entering dehumidifier 12. Dehumidifier 12 maintains a desiccant, which dehumidifies gas stream A by counter-currently contacting the desiccant in dehumidifier 12 with gas stream A. The desiccant in dehumidifier 12 is a hydroscopic substance that removes moisture from gas stream A passing through dehumidifier 12. Removal of water from gas stream A is an adiabatic process, and in thermodynamics an adiabatic process is one in which the specific enthalpy of the air remains constant. Continuous desiccant dehumidification can be accomplished using solid packed towers, rotating horizontal beds, multiple vertical beds, rotating wheels, as well as liquid desiccant approaches employing vertical spray towers or wetted media. The rotating wheel is the best known and is made of a finely divided desiccant material usually silica gel, titanium silicates, or some type of zeolite that is impregnated into a fibrous support structure.

Moisture reduction per volume of air utilized by the invention can be up to 30 times greater than found in commercial dehumidification applications. Thus, the desiccant removal mechanism may possess multiple stages. Desiccant concentrations and their effects on the behavior of air streams are more easily determinable when employing liquid desiccant, which is, as a result, a preferred desiccant. The processes are described in greater detail in FIG. 4 and FIG. 5.

Figure 12:
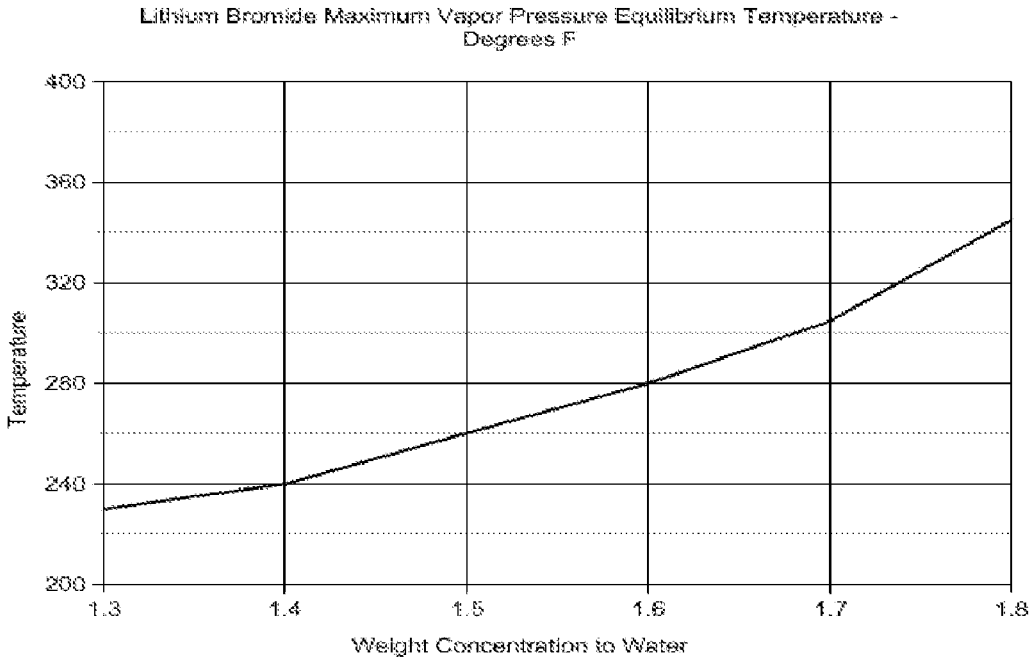
FIG. 12 is a graph of approximate concentrations of lithium bromide solution as compared with water.

The process carried out by thermo-chemical pump 10 can operate as an open system exhausting air to the environment, and it is preferred that the desiccants used pose insignificant environmental risk. A preferred desiccant utilized by dehumidifier 12 is a liquid desiccant. A preferred liquid desiccant is lithium bromide, and other liquid desiccants, including those with higher boiling points, may be used in other embodiments. FIG. 12 displays approximate concentrations of lithium bromide solution as compared with water. The upper limits of the affinity of lithium bromide for moisture absorption can be referred to as the equilibrium point between the vapor pressures between the vapor pressures of the gas and liquid. For instance, balance at 1.5 concentration is 260° F. while at 1.8 balance exceeds 260° F.

Mixtures of air and water vapor are the most common systems encountered in psychrometry, which is the study of their physical and thermodynamic properties. A psychrometric chart graphically expresses the ways various properties relate to each other. When following the calculated line for enthalpy, for example, an 80° F. saturated air stream (100% relative humidity) contains the same energy were it approximately 145° F. and 5% relative humidity. Along with the increase in air temperature as a result of dehumidification, the amount of moisture in the air has reduced from 0.022 pounds of water per pound of air to less than 0.008. As used herein, relative humidity is the amount of water vapor actually in air divided by the amount of water vapor the air could hold. Relative humidity can be calculated by dividing actual vapor pressure by saturation vapor pressure.

Figure 13:
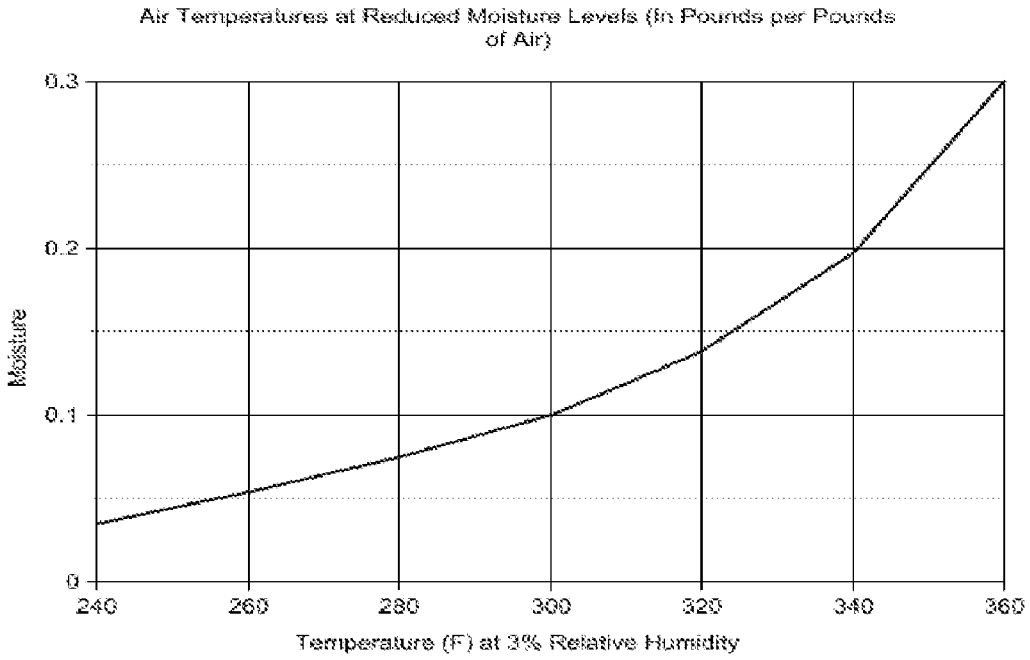
FIG. 13 is a graph of temperatures generated by adiabatic dehumidification in a gas or air stream.

As viewed in FIG. 13, temperatures generated by adiabatic dehumidification are dependent upon the initial moisture in the gas or air stream. For example and as found in the graph of FIG. 10, saturated air of gas stream A, in a particular embodiment, at 140° F. contains 0.15 pounds of water per pound of air. Temperature of this air of gas stream A in this example is raised to 305° F. when adiabatically dehumidified in dehumidifier 12 to three percent relative humidity. Likewise, saturated air of gas stream A, in a particular embodiment, at 175° F. holding 0.53 pounds of water per pound of air will increase in temperature to 345° F. when dehumidified in dehumidifier 12 to five percent relative humidity containing 645 Btu per pound of air.

Following adiabatic dehumidification of gas stream A in dehumidifier 12, gas stream A, which is now has a temperature much greater after dehumidification in dehumidifier 12 as compared to the temperature of gas stream A prior to dehumidification before entering dehumidifier 12 from plenum 20, is applied to plenum 21 from dehumidifier 12. In certain applications, the heat of gas stream A from dehumidifier 12 may be used directly upon its exit from dehumidifier 12. According to a preferred embodiment of the invention, gas stream A is applied to heat exchanger 13 from plenum 21, in which heat exchanger interacts with or otherwise acts on gas stream A such that gas stream A is heat exchanged, such as with a cooler liquid or gas, and there is a resulting discharged at 34. When cooling, the gas of gas stream A saturates at a relatively high temperature with an exit per the above example at nearly 172° F. with enthalpy content of 568 Btu. Heat transfer is the difference between 645 and 568 Btu giving 77 Btu per pound of air. As the adiabatic changes to the gas of gas stream A tend to cancel, energy transferred to saturated gas stream A at heater-saturator 11 from heated water source 30 approximates except for process losses that removed from gas stream A by heat transfer, such as to a cooler liquid or gas, in heat exchanger 13. As the 172° F. saturated gas is considerably warmer than the fluid exiting most turbines employed for electrical generation, further heat exchange is possible with additional heat transfer balanced by energy additions in heat exchanger 13.

In a particular aspect of the invention, gas stream A may be continually dehumidified in heat exchanger 13, in a continuous or staged manner, again working with relative humidity equilibriums. In this mode of operation, the gas temperature of gas stream A may be heat exchanged with a cool liquid or gas in heat exchanger 13 to a much reduced temperature. Looking to the above example, the five percent relative humidity of the 345° F. air becomes 10% at an air temperature of 295° F. allowing further moisture removal, such as by a desiccant. In the example of this procedure continued to an air temperature of 129° F. and 90% relative humidity, the enthalpy content reduces to 155 Btu per pound of air, in which heat transfer to the cooler fluid would is calculated as 645 less 155 or 490 Btu per pound of air. Concurrently, moisture removal from the air in the heat exchanger has increased from zero to 0.37 pounds per pound of air with dehumidification. The modes of heat exchange are more fully appreciated in connection with FIG. 6 and FIG. 7 presented below. Following heat exchange in heat exchanger 13, gas stream A is applied from heat exchanger 50 to plenum 22. Gas stream A passes through plenum 22 to blower 23, which then acts on gas stream A and applies gas stream A to saturator 11 from plenum 22, and the above process continues.

Figure 14:
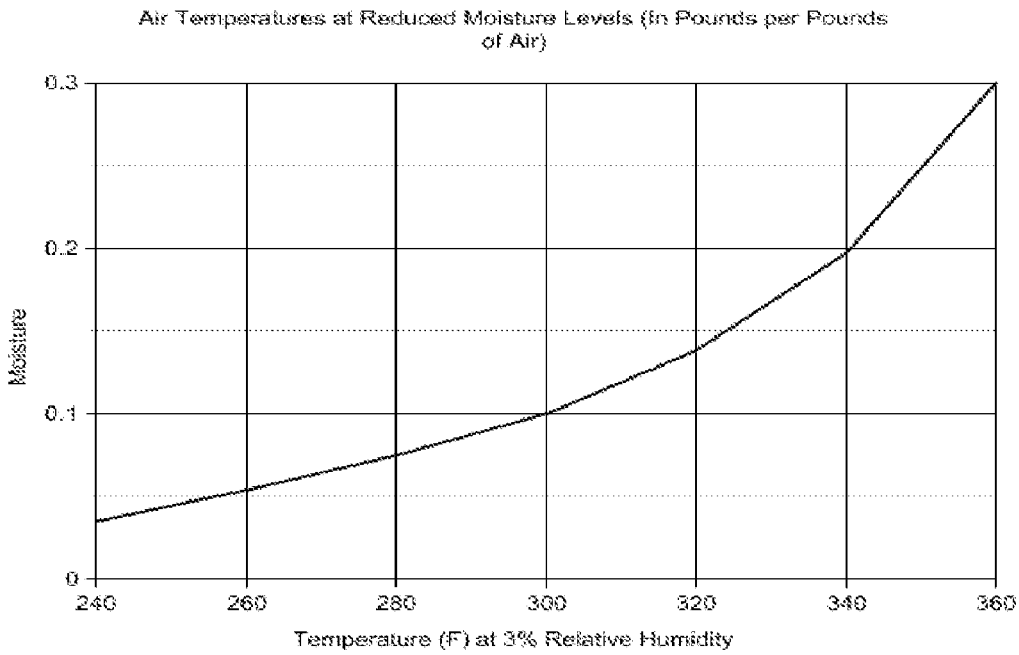
FIG. 14 is a graph of water absorption relative to desiccant concentration.

A contribution of the invention is the ability to deploy desiccants largely throughout their absorption ranges. Saturated air exiting contact with the heat from the heated water of heated water source 30 in heater-saturator 11 may be contacted with a desiccant capable of significantly reducing the air saturation level. Again suggesting the counter-current arrangement of a gas stream and the desiccant, a gas stream relative humidity may range from approximately 5% to 90%. This range provides for considerable change of desiccant concentrations. In the example of lithium bromide, the amount of water absorbed greatly increases as the desiccant dilutes. As seen in FIG. 14, movement from the 1.8 concentration (utilized as the measurement base) to a concentration of 1.7 causes the addition of only 11% more water whereas the dilution from 1.4 to 1.3 requires a dilution of 90%. Overall there is absorption of 190% when compared with an initial 1.8 concentration.

Partial removal of absorbed water from a dilute liquid desiccant may be accomplished by contacting the desiccant with an ambient air stream, especially in dryer climatic conditions. Supplemental heating of an ambient air stream significantly reduces the relative humidity levels. Using an earlier example, the harsh conditions of 95° F., 40% relative humidity would deliver a satisfactorily concentrated desiccant when heated to 180° F. Regenerator 70 for concentrating liquid desiccant is described more fully in FIG. 9 and desiccant regeneration is explained in FIG. 5.

In cases where the heated gas is utilized directly upon its exit dehumidifier 12 in reference to FIG. 1, or in other cases in which the gas is not re-circulated through pump 10, plenum 22 is coupled to supply outside air to heater-saturator 11. This air may be heat exchanged with any residual heat remaining in the gas of gas stream A exiting plenum 21 following its process utilization. This exchange could take place in a cross flow heat exchanger similar to that shown in FIG. 9.

Figure 2:
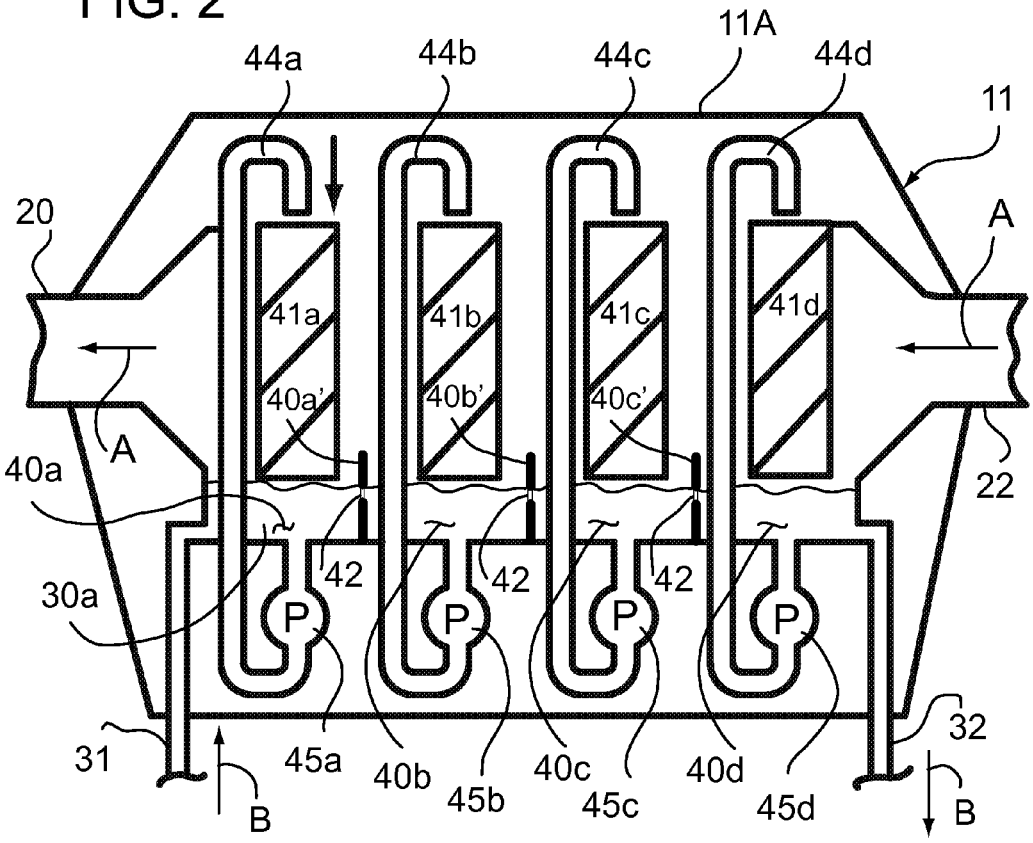
FIG. 2 is a schematic diagram of a heater and saturator of the thermo-chemical heat pump of FIG. 1.

Reference is now made to FIG. 2, which is a schematic diagram of heater-saturator 11 of thermo-chemical pump 10 of FIG. 1 illustrating direct heating and evaporation by a low temperature thermal source, namely, heated water source 30 denoted in FIG. 1 in the preferred embodiment. In FIG. 2, detail is presented relative to the direct mode of simultaneously increasing the temperature of gas stream A while maintaining gas stream A in a near saturated condition. Direct contact between heated water 30A of heated water source 30 (FIG. 1) and gas stream A raises the temperature of gas stream A and concurrently evaporates water vapor from water 30A into gas stream A as the saturation condition of gas stream A continually changes as gas stream A passes through heater-saturator 11 from plenum 22 to plenum 20. This method is preferred when heated water consists of the thermal source, as in the present embodiment, owing to its simplicity and inexpensive cost.

Referencing FIG. 2, heater-saturator 11 consists of a housing 11A is formed with basins 40*a*, 40*b*, 40*c*, and 40*d*, which are formed between plenums 20 and 22. Basin 40*a* is coupled in fluid communication to inlet 31, and basin 40*d* is coupled in fluid communication to outlet 32. Heat exchange medias 41*a*, 41*d*, 41*c*, and 41*c* are formed in basins 40*a*, 40*b*, 40*c*, and 40*d*, respectively. Water 30A of heated water source 30 denoted in FIG. 1 passes through heater-saturator 11 from inlet 31 to outlet 32 in the direction indicated by the arrowed line B, which is opposite to the flow of gas stream A through saturator 11. Partitions 40*a*', 40*b*', and 40*c*' provide effective separation between basins 40*a*-40*d*. Basins 40*a*-40*d* are connected in fluid communication by openings 41 formed in the respective partitions 40*a*'-40*c*' between basins 40*a*-40*d* that allow water 30A to migrate through basins 40*a*-40*d* from basin 40*a* to basin 40*d*, which is, as explained above, a counter-current flow with respect to gas stream A flowing through heater-saturator 11 from plenum 22 to plenum 20.

Conduits 44*a*, 44*b*, 44*c*, and 44*d*, are coupled in fluid communication to the respective basins 40*a*, 40*b*, 40*c*, and 40*d*. Pumps 45*a*, 45*b*, 45*c*, and 45*d* are formed in the respective conduits 44*a*, 44*b*, 44*c*, and 44*d*, and operate to pump water 30A of heated water source 30 from basins 40*a*, 40*b*, 40*c*, and 40*d*, to the respective medias 41*a*, 41*b*, 41*c*, and 41*d* located in gas stream A passing through heater-heater-saturator 11, which water 30A falls by gravity through medias 41*a*, 41*b*, 41*c*, and 41*d* and collects in the respective basins 40*a*, 40*b*, 40*c*, and 40*d*. Each basin and its respective media and pump and conduit are considered a stage, and in the present embodiment there are four stages and less or more may be used if so desired.

In operation, gas stream A enters heater-saturator 11 from plenum 22, and has a temperature that is less than the temperature of water 30A conducting through heater-saturator 11 from inlet 31 to outlet 32. Gas stream A passes through heater-saturator 11 from plenum 22 to plenum 20, directly interacts with water 30A in medias 41*a*-41*d* and basins 40*a*-40*d*, picks up heat and moisture from water 30A becoming saturated, and exits heater-saturator 11 into plenum as saturated gas stream A in preparation for application to dehumidifier 12 for dehumidification.

Figure 3:
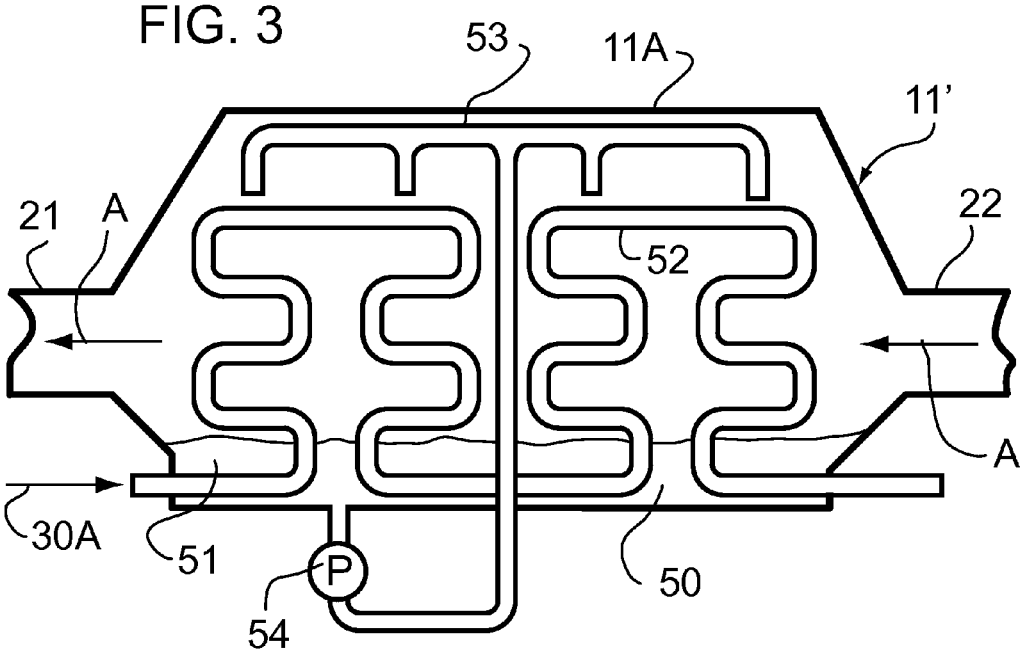
FIG. 3 is a schematic diagram of an alternate embodiment of a heater and saturator of the thermo-chemical heat pump of FIG. 1.

The embodiment of heater-saturator 11 in FIG. 2 is exemplary of direct heating and saturation. FIG. 3 is a schematic representation of an alternate embodiment of heater-saturator denoted at 11' that is exemplary of indirect heating and saturation. In heater-saturator 11' depicted in FIG. 3, housing 11A is formed with a basin 50 that maintains a volume of water 51. An elongate conduit 52 is positioned in heater-saturator 11, snakes up-and-down and back-and-forth between plenums 22 and 20, and is coupled in fluid communication with inlet 31 at plenum 20 and to outlet 32 at plenum 22. Water 30A of heated water source 30 denoted in FIG. 1 passes through conduit 52 from inlet 31 to outlet 32, and thus conveys water 30A through heater-saturator 11' in a direction from plenum 20 to plenum 22, which is opposite to or otherwise counter current with respect to gas stream A passing through heater-saturator 11 in a direction from plenum 22 to plenum 20. A dispersal conduit 53 is coupled in fluid communication to basin 50. Pump 54 is formed in dispersal conduit 43, and operates to pump water 51 from basin 50 conduit 52 located in gas stream A passing through heater-saturator 11', which water 51 is dispersed onto conduit 52 from dispersal conduit 53 and falls by gravity onto conduit 52 and is heated and which collects back in basin 50 for recirculation through dispersal conduit 53.

In operation, gas stream A enters heater-saturator 11' from plenum 22, and has a temperature that is less than the temperature of water 30A conducting through conduit 52 through heater-saturator 11' from inlet 31 to outlet 32. Gas stream A passes through heater-saturator 11' from plenum 22 to plenum 20, indirectly interacts with water 30A passing through conduit 52 and is heated by the heat of water 30A passing through conduit 52 as is water 51 circulating in heater-saturator 11' via pump 54 and dispersal conduit 53. As such, gas stream A picks up heat from heat imparted to conduit 52 from the heat of water 30A, and picks up moisture from water 51 raining down upon conduit 52 becoming saturated, and exits heater-saturator 11' into plenum 20 as saturated gas stream A in preparation for dehumidification in dehumidifier 12, the details of which will now be discussed.

Figure 4:
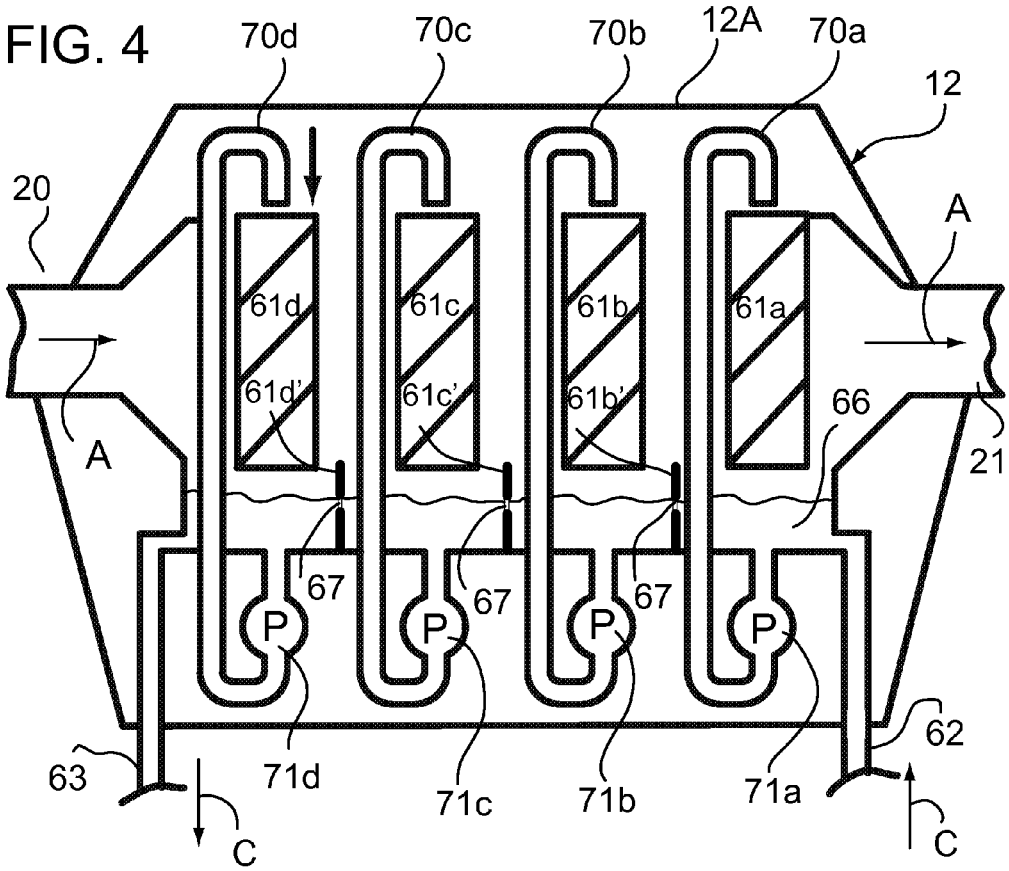
FIG. 4 is a schematic diagram of a dehumidifier of the thermo-chemical heat pump of FIG. 1.

Referencing FIG. 4, which is a schematic diagram of dehumidifier 12 of pump 10 of FIG. 1, dehumidifier 12 consists of a housing 12A that is formed with basins 60*a*, 60*b*, 60*c*, and 60*d*, which are formed between plenums 20 and 22. Basin 60*a* is coupled in fluid communication to an inlet 62 located proximate to plenum 21, and basin 60*d* is coupled in fluid communication to an outlet 63 located proximate to plenum 20. Inlet 62 and outlet 63 are each coupled in fluid communication to a regenerator 65 denoted in FIG. 1, that maintains a liquid desiccant and that is thus a source of liquid desiccant, and that circulates the liquid desiccant with respect to dehumidifier 12 via inlet 62, basins 60*a*-60*d*, and outlet 63. Heat exchange medias 61*a*, 61*d*, 61*c*, and 61*c* are formed in basins 60*a*, 60*b*, 60*c*, and 60*d*, respectively. The liquid desiccant, which is denoted in FIG. 4 at 66, passes through dehumidifier 12 from inlet 31 to outlet 32 in the direction indicated by the arrowed lines C, which is opposite to the flow of gas stream A through dehumidifier 12. Partitions 60*a*', 60*b*', and 60*c*' provide effective separation between basins 60*a*-60*d*. Basins 60*a*-60*d* are connected in fluid communication by openings 67 formed in each of partitions 60*a*'-60*c*' between basins 40*a*-40*d* that allow desiccant 66 to migrate through basins 40*a*-40*d* from basin 40*a* to basin 40*d* from inlet 62 to outlet 63, which is a counter-current flow with respect to gas stream A flowing through dehumidifier 12 from plenum 20 to plenum 21.

Conduits 70*a*, 70*b*, 70*c*, and 70*d*, are coupled in fluid communication to the respective basins 60*a*, 60*b*, 60*c*, and 60*d*. Pumps 71*a*, 71*b*, 71*c*, and 71*d* are formed in the respective conduits 70*a*, 70*b*, 70*c*, and 70*d*, and operate to pump desiccant 66 of regenerator 65 from basins 60*a*, 60*b*, 60*c*, and 60*d*, to the respective medias 61*a*, 61*b*, 61*c*, and 61*d* located in gas stream A passing through dehumidifier 12, which desiccant 66 falls by gravity through medias 61*a*, 61*b*, 61*c*, and 61*d* and collects in the respective basins 60*a*, 60*b*, 60*c*, and 60*d*. Each basin and its respective media and pump and conduit are considered a stage of dehumidifier 12, and in the present embodiment there are four stages and less or more may be used if so desired.

In operation, saturated gas stream A enters dehumidifier 12 from plenum 20. Saturated gas stream A passes through dehumidifier 12 from plenum 20 to plenum 21, and directly interacts with desiccant 66 in medias 61*a*-61*d* and basins 60*a*-60*d*, which picks up or otherwise takes on the moisture in gas stream A thereby drying gas stream A, which then exits dehumidifier 12 into plenum 21 in preparation for heat exchanging in heat exchanger 13 in FIG. 1, in accordance with the principle of the invention.

The dehumidification of saturated gas stream A passing through dehumidifier 12 is adiabatic dehumidification, and in response to the dehumidification of saturated air stream the dried gas stream A applied to plenum 21 from dehumidifier 12 is heated, in accordance with the principle of the invention, which said heat may be used for a beneficial or desired purpose. Desiccant 66 is concentrated when it enters basin 60*a* from inlet 62, and is diluted with the moisture picked up therein from saturated gas stream A when it is discharged into outlet 63 from basin 60*d*. The diluted desiccant is applied from outlet 63 to regenerator 65 denoted in FIG. 1, which operates to remove the collected moisture from the diluted desiccant 66 to re-concentrate the desiccant 66 or dry the desiccant 66, which is then applied back to dehumidifier 12 to dehumidify saturated gas stream A.

Dehydration of air stream A can, if desired, by carried out with a conventional cooling tower with the desiccant falling counter-currently to an uprising air stream. While useful, this dehumidification approach is less efficient than the preferred embodiment of dehumidifier 12 discussed above.

Figure 5:
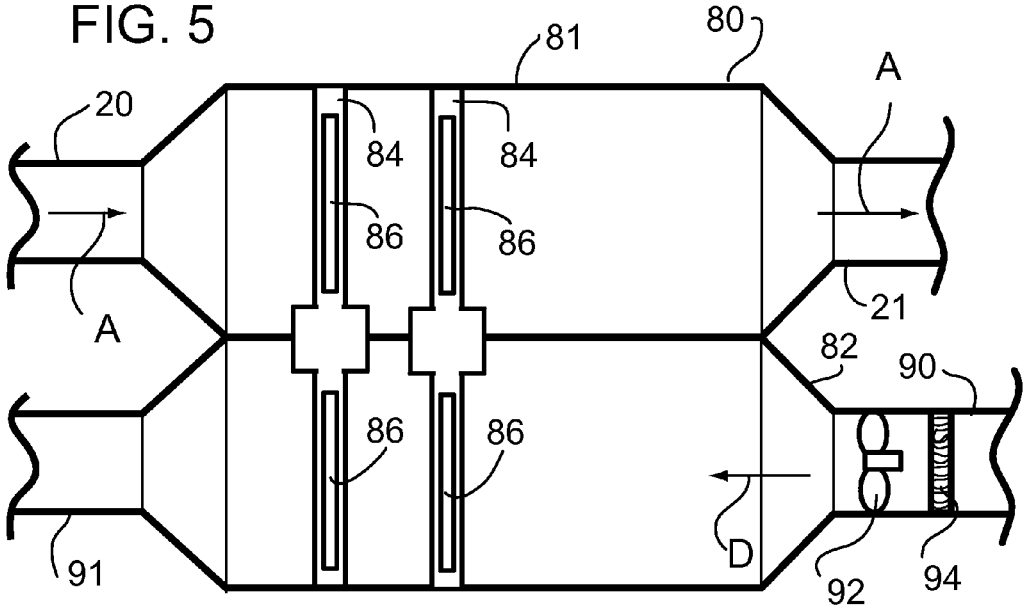
FIG. 5 is a schematic diagram of an alternate embodiment of a dehumidifier for use with the thermo-chemical heat pump of FIG. 1.

FIG. 5 is a schematic diagram of an alternate embodiment of a dehumidifier for use with thermo-chemical pump 10 of FIG. 1, which is denoted at 80. Dehumidifier 80 includes opposed, substantially coextensive, parallel housings 81 and 82. Housing 81 is coupled in gaseous communication with gas stream A via plenums 20 and 21, and saturated gas stream A passes into housing 81 of dehumidifier 80 from plenum 20 and out of housing 81 into plenum 21. Rotating wheels 84 impregnated with solid desiccant denoted at 86 are formed between housings 81 and 82, and rotate with respect to housings 81 and 82. Wheels 84 are placed concurrently through housings 81 and 82. Housing 82 is coupled to an inlet 90 and an outlet 91. A fan or blower 92 is formed in inlet 90. In response to activation of blower 92, gas stream D is formed in housing 81 which passes through housing from inlet 90 to outlet 91, which flows counter-currently with respect to the flow of gas stream A passing through housing 81. Gas stream D is a dry gas stream. Gas stream D is simply an ambient air gas stream, but may be formed of one or more other gases in other examples.

In response to rotation of wheels 84, saturated gas stream A passing through housing 81 interacts with solid desiccant 86 carried by wheels 84 to adiabatically dehumidify gas stream A, which is then applied to plenum 21 from housing 81. Solid desiccant 86 impregnated in wheels 84 rotating through housing 81 interacts with saturated gas stream A entering housing 81 from plenum 20 and picks up the moisture in saturated gas stream A thereby drying gas stream A, that is then applied from housing 81 to plenum 21. As wheels 84 rotate from housing 81 to housing 82, the wetted solid desiccant 86 is brought into contact with gas stream D, which picks up the moisture from solid desiccant 86 through housing 82, which gas stream D is then discharged from housing 82 through outlet 91, thereby drying solid desiccant 86 in preparation for rotation back into housing 81 to adiabatically dehumidify saturated gas stream A and this process so continues. In the present example, two wheels 84 are formed in dehumidifier 80, and less or more can be used if so desired. As gas stream D interacts with wetted solid desiccant 86 rotating through housing 82 by wheels 84, the moisture held by solid desiccant 86 is adiabatically evaporated into gas stream D, which is discharged through outlet 91. If desired, gas stream D may be heated by a heater 94 before application to housing 82 to enhance the adiabatic evaporation of moisture into gas stream D from the wetted solid desiccant 86 rotating through housing 82 by wheels 84. In the present embodiment, heater 94 is formed in inlet 90 upstream of blower 92, but may be formed downstream of blower 92 if desired. Heater 94 is a conventional electric heater or air conditioning device well known to those having ordinary skill. If desired, air stream D may be heated by heat exchanger 13 in FIG. 1.

Reference is now made to FIG. 6, which is a schematic diagram of heat exchanger 13 of thermo-chemical pump 10 of FIG. 1. Heat exchanger 13 consists of a housing 100 coupled in gaseous communication to plenums 21 and 22. Heated gas stream A applied to plenum 21 from dehumidifier 12 enters housing 100 from plenum 21, is heat exchanged, and is then applied from housing 100 to plenum 22, which, in turn, conveys gas stream A back to heater-saturator 11 for recirculation of gas stream A through pump 10. A conduit 101 is formed in housing 100, which has an inlet 102 formed proximate to plenum 22, and an outlet 103 formed proximate to plenum 21. A fluid stream denoted by the arrowed lines E passes through conduit 101 from inlet 102 to outlet 103, which is a counter current flow with respect to the flow of gas stream A through housing 100, and is heat exchanged with gas stream A passing through housing 100. Heat exchanger 13 is exemplary of a conventional gas-to-liquid heat exchanger, and other suitable heat exchangers may be used to heat exchange with air stream A without departing from the invention.

FIG. 7 is a schematic drawing of an alternate embodiment of a heat exchanger for use with pump 10 of FIG. 1, which is denoted at 13'. In this embodiment, heat exchanger 13' provides heat exchanging with gas stream A and concurrent dehumidification of gas stream A during heat exchanging. In common with heat exchanger 13 in FIG. 6, the embodiment of heat exchanger 13' in FIG. 7 shares housing 100 coupled in gaseous communication to plenums 21 and 22, in which heated gas stream A applied to plenum 21 from dehumidifier 12 enters housing 100 from plenum 21, is heat exchanged, and is then applied from housing 100 to plenum 22, which, in turn, conveys gas stream A back to saturator 11. In the present example, a conduit 110 is formed in housing 100, which has an inlet 111 formed proximate to plenum 22, and an outlet 112 formed proximate to plenum 21. Conduit 110 snakes up-and-down and back-and-forth through housing 100. A fluid stream denoted by the arrowed lines F passes through conduit 110 from inlet 111 to outlet 112, which is a counter current flow with respect to the flow of gas stream A through housing 100, and is heat exchanged with gas stream A passing through housing 100.

Housing 100 in heat exchanger 13' in FIG. 7 is formed with basins 120*a*, 120*b*, 120*c*, and 120*d*, which are formed between plenums 21 and 22. Basin 120*a* is coupled in fluid communication to an inlet 124 located proximate to plenum 22, and basin 120*d* is coupled in fluid communication to an outlet 125 located proximate to plenum 21. Inlet 124 and outlet 125 are each coupled in fluid communication to regenerator 65 denoted in FIG. 1, that maintains a liquid desiccant and that is thus a source of liquid desiccant, and that circulates the liquid desiccant with respect to heat exchanger 13 in FIG. 7 via inlet 124, basins 120*a*-120*d*, and outlet 125. The liquid desiccant, which is denoted in FIG. 7 at 66, passes through heat exchanger 13 in FIG. 7 from inlet 124 to outlet 125 in the direction indicated by the arrowed lines G, which is the same direction with respect to the flow of gas stream A through dehumidifier 12. Partitions 120*a*', 120*b*', and 120*c*' provide effective separation between basins 120*a*-120*d*. Basins 120*a*-120*d* are connected in fluid communication by openings 126 formed in each of partitions 120*a*'-120*c*' between basins 120*a*-120*d* that allow desiccant 66 to migrate through basins 120*a*-120*d* from basin 120*a* to basin 120*d* from inlet 124 to outlet 125, which is a counter-current flow with respect to gas stream A flowing through heat exchanger 13' in FIG. 7 from plenum 21 to plenum 22.

With continuing reference to FIG. 7, conduit nozzles 121*a*, 121*b*, 121*c*, and 121*d*, are coupled in fluid communication to the respective basins 120*a*, 120*b*, 120*c*, and 120*d*. Pumps 122*a*, 122*b*, 122*c*, and 122*d* are formed in the respective conduit nozzles 121*a*, 121*b*, 121*c*, and 121*d*, and operate to pump desiccant 66 of regenerator 65 from basins 120*a*, 120*b*, 120*c*, and 120*d*, to the respective conduit nozzles 121*a*, 121*b*, 121*c*, and 121*d*, which spray liquid desiccant 66 into gas stream A flowing through housing 100 which contacts or otherwise interacts with gas stream A and continually dehumidifies gas stream A as it is concurrently heat exchanged. Desiccant 66 sprayed into gas stream A passing through housing 100 of heat exchanger 13' in FIG. 7 continuously dehumidifies gas stream A flowing through housing 100 as it is concurrently heat exchanged and picks up moisture collected by gas stream A as it cools, which desiccant 66, which is now diluted with moisture picked up from gas stream A, falls by gravity and collects in the respective basins 120*a*, 120*b*, 120*c*, and 120*d*. Each basin and its respective media and pump and conduit are considered a stage of heat exchanger 13' in FIG. 7, and in the present embodiment there are four stages and less or more may be used if so desired.

The dehumidification of saturated gas stream A passing through heat exchanger 13' in FIG. 7 is adiabatic dehumidification. Desiccant 66 is concentrated when it enters basin 120*a* from inlet 124, and is diluted with the moisture picked up therein from gas stream A during its heat exchanging when it is discharged into outlet 125 from basin 120*d*. The diluted desiccant is applied from outlet 125 to regenerator 65 denoted in FIG. 1, which operates to remove the collected moisture from the diluted desiccant 66 to re-concentrate the desiccant 66, which is then applied back to heat exchanger 13' set forth in FIG. 7 to dehumidify gas stream A passing therethrough concurrently with heat exchanging.

Figure 8:
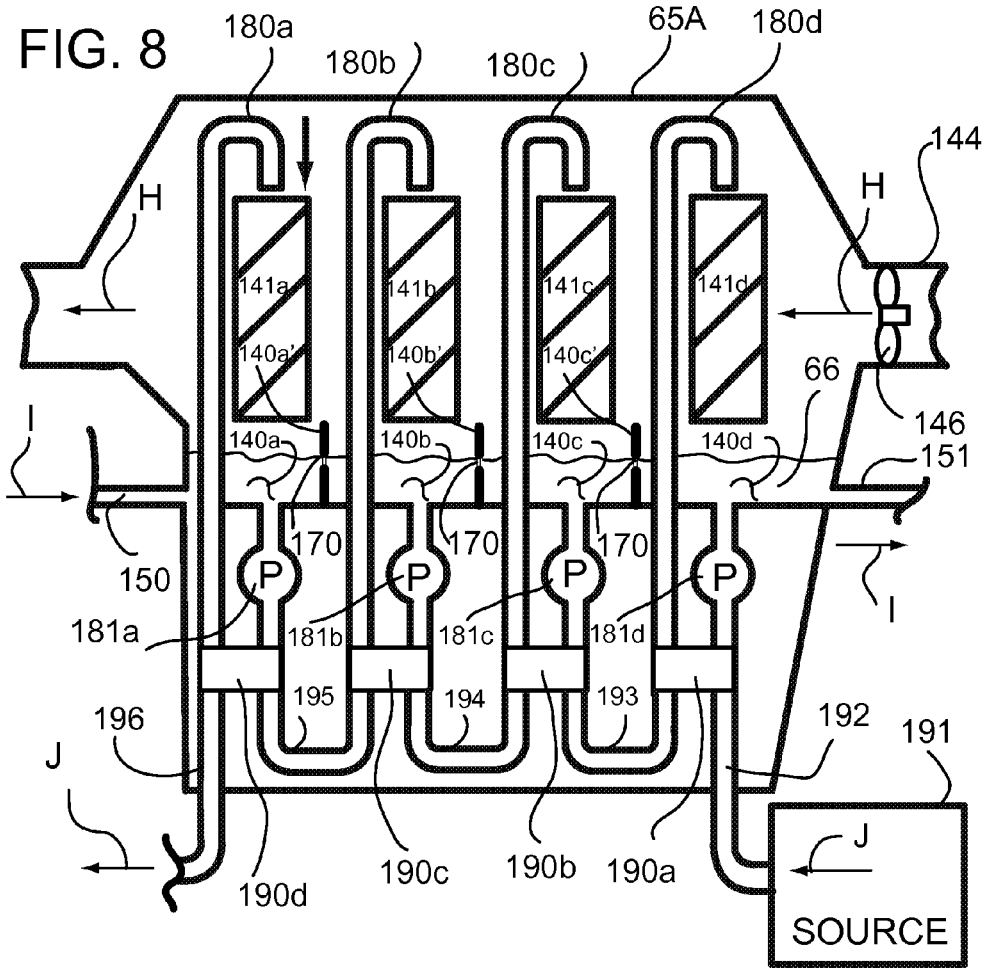
FIG. 8 is a schematic diagram of a regenerator of the thermo-chemical heat pump of FIG. 1.

Reference is now made to FIG. 8, which is a schematic representation of regenerator 65. Regenerator 65 consists of a housing 65A that is formed with basins 140*a*, 140*b*, 140*c*, and 140*d*, which are formed between plenums 144 and 145. Plenum 144 is an intake plenum, and plenum 145 is an outtake plenum. A fan or blower 146 is formed in plenum 144. In response to activation of blower 146, gas stream H is formed in housing 65A which passes through housing 65A from plenum 144 to plenum 145. Gas stream H is a dry gas stream. Gas stream H is simply an ambient air gas stream, but may be formed of one or more other gases in other examples. Basin 140*a* is coupled in fluid communication to an inlet 150 located proximate to plenum 145, and basin 140*d* is coupled in fluid communication to an outlet 151 located proximate to plenum 144. Inlet 150 is coupled in fluid communication to a return conduit 154 illustrated in FIG. 1, and outlet 151 is coupled in fluid communication to a supply conduit 155 illustrated in FIG. 1.

Referencing FIG. 1, return conduit 154 is coupled in fluid communication to a dehumidifier return conduit 160, which is, in turn, coupled in fluid communication to outlet 63 of dehumidifier 12. Return conduit 154 is also coupled in fluid communication to a heat exchanger return conduit 161, which is, in turn, coupled in fluid communication to outlet 125 of heat exchanger 13' of FIG. 7. Supply conduit 155 is coupled in fluid communication to a dehumidifier supply conduit 162, which is, in turn, coupled in fluid communication to inlet 62 of dehumidifier 12. Supply conduit 155 is also coupled in fluid communication to a heat exchanger supply conduit 163, which is, in turn, coupled in fluid communication to inlet 124 of heat exchanger 13' of FIG. 7.

Regenerator 65 illustrated in FIG. 8 maintains a liquid desiccant 66 and is thus a source of liquid desiccant, and circulates the liquid desiccant with respect to dehumidifier 12 and heat exchanger 13' of FIG. 7, receiving diluted liquid desiccant from dehumidifier 12 and heat exchanger 13' of FIG. 7, and returning concentrated or undiluted liquid desiccant back to dehumidifier 12 and heat exchanger 13' of FIG. 7. Heat exchange medias 141*a*, 141*d*, 141*c*, and 141*c* are formed in basins 140*a*, 140*b*, 140*c*, and 140*d*, respectively. Diluted liquid desiccant 66 is applied to conduits 160 and 161 from the respective outlets 63 and 125 of dehumidifier 12 and heat exchanger 13' of FIG. 7, which convey the diluted liquid desiccant to return conduit 154. Return conduit 154, in turn, conveys the diluted liquid desiccant to inlet 150, which applies the diluted liquid desiccant to basin 140*a*, which passes through regenerator 65 from inlet 150 to outlet 151 in the direction indicated by the arrowed lines I, which is counter current with respect to gas stream H flowing through housing 65A from plenum 144 to plenum 145. As the diluted liquid desiccant 66 passes through regenerator 65, regenerator 65 operates to remove the moisture from the diluted liquid desiccant 66 to concentrate and thus reconstitute the liquid desiccant 66, which is then applied from regenerator 65 to dehumidifier 12 and heat exchanger 13' of FIG. 7 for dehumidification of gas stream A denoted in FIG. 1.

The liquid desiccant, which is denoted in FIG. 8 at 66, passes through regenerator 65 from inlet 150 to outlet 151 in the direction indicated by the arrowed lines I, which is opposite to the flow of gas stream H through housing 65A of regenerator 65. Partitions 140*a*', 140*b*', and 140*c*' provide effective separation between basins 140*a*-140*d*. Basins 140*a*-140*d* are connected in fluid communication by openings 170 formed in each of partitions 140*a*'-140*c*' between basins 40*a*-

40*d* that allow desiccant 66 to migrate through basins 140*a*-140*d* from basin 140*a* to basin 140*d* from inlet 150 to outlet 151.

Conduits 180*a*, 180*b*, 180*c*, and 180*d*, are coupled in fluid communication to the respective basins 140*a*, 140*b*, 140*c*, and 140*d*. Pumps 181*a*, 181*b*, 181*c*, and 181*d* are formed in the respective conduits 180*a*, 180*b*, 180*c*, and 180*d*, and operate to pump desiccant 66 of regenerator 65 from basins 140*a*, 140*b*, 140*c*, and 140*d*, to the respective medias 141*a*, 141*b*, 141*c*, and 141*d* located in gas stream H passing through housing 65A of regenerator 65, which desiccant 66 falls by gravity through medias 141*a*, 141*b*, 141*c*, and 141*d* and collects in the respective basins 140*a*, 140*b*, 140*c*, and 140*d*. Each basin and its respective media and pump and conduit are considered a stage of regenerator 65, and in the present embodiment there are four stages and less or more may be used if so desired.

In operation, gas stream H enters housing 65A of regenerator 65 from plenum 20, which gas stream H is formed by operation of blower 146. Gas stream H passes through housing 65A from plenum 144 to plenum 145, directly interacts with desiccant 66 in medias 141*a*-141*d* and basins 140*a*-140*d*, and picks up or otherwise takes on the moisture from liquid desiccant 66 through evaporation thereby dehumidifying or drying liquid desiccant 66 thereby un-diluting and concentrating the diluted liquid desiccant 66 passing through regenerator 65 through basins 140*a*-140*d* from inlet 150 to outlet 151 to form dry or concentrated liquid desiccant 66 at basin 140*d*, which concentrated liquid desiccant 66 is applied to outlet 151 from basin 140*d*, which is then conveyed to dehumidifier 12 and heat exchanger 13' of FIG. 7. The moisture picked up from liquid desiccant 66 by gas stream H passing through housing 65A of regenerator 65 from plenum 144 to plenum 145 is discharged by gas stream H through outlet 145. And so desiccant 66 is diluted with moisture picked up in dehumidifier 12 and heat exchanger 13' of FIG. 7 when it enters basin 140*a* from inlet 150, and is concentrated and substantially free of moisture when it is discharged into outlet 151 from basin 140*d*. The concentrated desiccant 66 is applied from outlet 151 to supply conduit 155 and FIG. 1, and from supply conduit 155 to supply conduits 162 and 163. The liquid desiccant applied to conduit 162 is conveyed to dehumidifier 12 via inlet 62 to dehumidify gas stream A passing through dehumidifier 12, and the liquid desiccant applied to conduit 163 is conveyed to heat exchanger 13' of FIG. 7 via inlet 125 to dehumidify gas stream A passing through heat exchanger 13' concurrently with the heat exchanging of gas stream A passing through heat exchanger 13'.

With further reference to FIG. 8, heat exchangers 190*a*, 190*b*, 190*c*, and 190*d* are formed in the respective conduits 180*d*, 180*c*, 180*b*, and 180*a*. Heat exchangers 190A, 190*b*, 190*c*, and 190*d* are coupled to receive heated water from heated water thermal source 191, and are coupled to receive liquid desiccant 66 pumped by pumps 181*a*, 181*b*, 181*c*, and 181*d* to the respective medias 141*a*, 141*b*, 141*c*, and 141*d*. Heat exchangers 190*a*, 190*b*, 190*c*, and 190*d* exchange heat between thermal source 191 and liquid desiccant 66 heating liquid desiccant 66 in preparation for application to the respective medias 141*a*, 141*b*, 141*c*, and 141*d*, which heat imparted to liquid desiccant 66 applied to the respective medias 141*a*, 141*b*, 141*c*, and 141*d* assists in evaporating the moisture in liquid desiccant 66 to gas stream H passing through housing 65A of regenerator, in accordance with the principle of the invention.

In the present example, heat exchangers 190*a*, 190*b*, 190*c*, and 190*d* are formed in the respective conduits 180*d*, 180*c*, 180*b*, and 180*a* between the respective pumps 181*d*, 181*c*, 181*b*, and 181*a* and the respective medias 141*d*, 141*c*, 141*b*, and 141*a*, but may be formed in conduits 180*d*, 180*c*, 180*b*, and 180*a* at other locations. In the present embodiment, an inlet 192 couples heat exchanger 190*a* in fluid communication to thermal source 191, a conduit 193 couples heat exchanger 190*a* in fluid communication to heat exchanger 190*b* to convey the heated water of thermal source 191 from heat exchanger 190*a* to heat exchanger 190*b*, a conduit 194 couples heat exchanger 190*b* in fluid communication to heat exchanger 190*c* to convey the heated water of thermal source 191 from heat exchanger 190*b* to heat exchanger 190*c*, a conduit 195 couples heat exchanger 190*c* in fluid communication to heat exchanger 190*d* to convey the heated water of thermal source 191 from heat exchanger 190*c* to heat exchanger 190*d*, and heat exchanger 190*d* is, in turn, coupled in fluid communication to an outlet 196 to discharge the heated water of thermal source 191 therefrom. The flow of the heated water through heat exchangers 190*a*-190*d* flows through heat exchangers 190*a*-190*d* in the direction indicated by the arrowed lines J, which is counter current with respect to the flow of liquid desiccant 66 through conduits 180*a*-180*d* from the respective pumps 181*a*-181*d* to the respective medias 141*a*-141*d*, and heat exchanges with the flow of liquid desiccant 66 through conduits 180*a*-180*d* to heat the liquid desiccant 66 in preparation for application to the respective medias 141*a*-141*d*.

Figure 9:
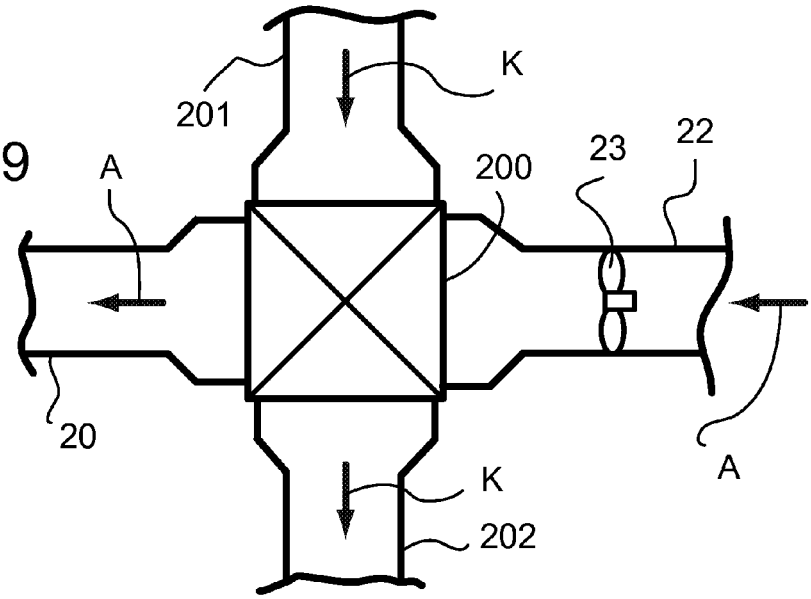
FIG. 9 is a schematic drawing of a heat exchanger positioned to cool a gas stream in preparation for application to a heater and saturator of the thermo-chemical heat pump of FIG. 1.

If desired, pump 10 may be configured with a device or system to apply cool or chilled air to gas stream A flowing through plenum 22 in preparation for application to saturator 10 denoted in FIG. 1, and an example of just such a device or system is illustrated in FIG. 9. In FIG. 9, a heat exchanger 200 is located in plenum 22 in gas stream A downstream of blower 23. Heat exchanger 200 is exemplary of a cross flow heat exchanger, and is coupled to intake and outtake plenums 201 and 202. Gas stream A passes through heat exchanger 200, and heat exchanger 200 is coupled to receive a cool gas stream K from intake plenum 201, and to discharge the cool gas stream K through outtake plenum 202. Cool gas stream K heat exchanges with gas stream A in heat exchanger 200 to cool gas stream A in preparation for application to saturator 11 of pump 10 denoted in FIG. 1. This cooling of gas stream A at heat exchanger 200 provides better and more efficient saturation of gas stream A in saturator 11. In a particular example, cool gas stream K may be constantly humidified or the cool air stream could be replaced with a cool liquid stream if so desired.

The present invention is described above with reference to preferred embodiments. However, those skilled in the art will recognize that changes and modifications may be made in the described embodiments without departing from the nature and scope of the present invention. Various changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A method, comprising:

providing a first gas stream having a first temperature and moisture content approximately saturating the first gas stream, wherein the step of providing the first gas stream having the first temperature and the moisture content approximately saturating the first gas stream comprises: providing a saturator;

providing a gas stream;

applying the gas stream to the saturator;

providing a heating source;

the gas stream contacting the heating source and saturator in staged and counter current flow to evaporate moisture into the gas stream to produce the first gas stream having the first temperature and the moisture content approximately saturating the first gas stream, removing the moisture content from the first gas stream to form a second gas stream having a second temperature greater than the first temperature of the first gas stream wherein the step of removing the moisture content from the first gas stream to form the second gas stream having the second temperature greater than the first temperature of the first gas stream comprises:

providing a dehumidifier;

applying the first gas stream to the dehumidifier;

the dehumidifier interacting with the first gas stream to remove the moisture content from the first gas stream to form the second gas stream having the second temperature greater than the first temperature of the first gas stream comprising the dehumidifier contacting the first gas stream with a desiccant in staged and counter-current flow removing the moisture content from the first gas stream to form the second gas stream having the second temperature greater than the first temperature of the first gas stream, heat exchanging the second gas stream having the second temperature greater than the first temperature of the first gas stream and wherein the step of heat exchanging the second gas stream having the second temperature greater than the first temperature of the first gas stream comprises:

providing a heat exchanger; and applying the second gas stream having the second temperature greater than the first temperature of the first gas stream counter-currently and in staged flow to the heat exchanger heat exchanging the second gas stream at the heat exchanger.

2. The method according to claim 1, wherein the step of contacting the first gas stream with a heating source further comprises directly contacting the first gas stream with heated water.

3. The method according to claim 1, wherein the step of contacting the first gas stream with a heating source further comprises indirect heat exchange with the first gas stream coupled with a saturator.

4. The method according to claim 1, wherein the step of contacting the first gas stream with the desiccant further comprises contacting the first gas stream with a liquid desiccant.

5. The method according to claim 4, wherein the step of contacting the first gas stream with the liquid desiccant comprises:

providing a source of the liquid desiccant; and coupling the source of the liquid desiccant to the dehumidifier to apply the liquid desiccant to the dehumidifier to contact the first air stream.

6. The method according to claim 1, wherein the step of contacting the first gas stream with the desiccant further comprises contacting the first gas stream with a solid desiccant.

7. The method according to claim 6, wherein the step of contacting the first gas stream with the solid desiccant further comprising applying the solid desiccant to more than one wheel coupled to the dehumidifier, and rotating more than one wheel with respect to the dehumidifier to rotate the solid desiccant to contact the first gas stream.

8. The method according to claim 1, further comprising dehumidifying the second dry stream currently with heat exchanging the dry gas stream at the heat exchanger by contacting the second gas stream with a desiccant at the heat exchanger currently with heat exchanging the second gas stream at the heat exchanger.

9. The method according to claim 8, wherein the step of contacting the second gas stream with the desiccant further comprises contacting the second gas stream with a liquid desiccant.

10. The method according to claim 9, wherein the step of contacting the second gas stream with the liquid desiccant comprises:

providing a source of the liquid desiccant; and coupling the source of the liquid desiccant to the heat exchanger to apply the liquid desiccant to the heat exchanger to contact the second air stream.

* * * * *